US012789054B2

(12) United States Patent
Higdon

(10) Patent No.: US 12,789,054 B2
(45) **Date of Patent: *Nov. 10, 2026**

(54) MULTI-COMPONENT GOLF CLUB HEAD

(71) Applicant: KARSTEN MANUFACTURING CORPORATION, Phoenix, AZ (US)

(72) Inventor: David A. Higdon, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 121 days.

This patent is subject to a terminal disclaimer.

(21) Appl. No.: 18/747,305

(22) Filed: Jun. 18, 2024

(65) Prior Publication Data

US 2024/0335708 A1 Oct. 10, 2024

Related U.S. Application Data

(63) Continuation of application No. 17/494,714, filed on Oct. 5, 2021, now Pat. No. 12,011,642, which is a (Continued)

(51) Int. Cl.
*A63B 53/04* (2015.01)
*A63B 53/08* (2015.01)

(52) U.S. Cl.
CPC .... *A63B 53/047* (2013.01); *A63B 2053/0491* (2013.01)

(58) Field of Classification Search
CPC ..... A63B 53/047; A63B 53/0433; A63B 53/0408; A63B 53/0487; A63B 2053/0491; A63B 60/02; A63B 2209/00
(Continued)

(56) References Cited

U.S. PATENT DOCUMENTS 2,332,342 A * 10/1943 Reach ..... A63B 53/047 473/248
4,340,230 A * 7/1982 Churchward ..... A63B 53/04 473/339

(Continued)

FOREIGN PATENT DOCUMENTS

CN 2738842 11/2005
JP 3144247 8/2008

OTHER PUBLICATIONS

PCT International Search Report and Written Opinion dated Jun. 10, 2020 from corresponding PCT Application No. PCT/US2020/20686.

(Continued)

*Primary Examiner* — John E Simms, Jr.

(57) ABSTRACT

Embodiments of golf club heads with enclosed weight members are described herein. In many embodiments, the club head comprises a body having a front end, a back end, a heel end, a toe end, a top rail, and a sole; the body further including a front body defining the front end; a rear body coupled to the front body, wherein the front body includes a first mating surface, and the rear body includes a second mating surface that mates with the first mating surface to join the rear body to the front body; a plurality of weight receptacles defined in one or both of the first mating surface and the second mating surface and one or more weight members received into the weight receptacles, the one or more weight members being formed of a third material having a third density; and wherein the one or more weight members are fully enclosed between the front body and the rear body.

8 Claims, 9 Drawing Sheets

Related U.S. Application Data continuation of application No. 16/806,855, filed on Mar. 2, 2020, now Pat. No. 11,135,486.

(60) Provisional application No. 62/812,803, filed on Mar. 1, 2019.

(58) Field of Classification Search
USPC ..... 473/328, 335, 337
See application file for complete search history.

(56) References Cited

U.S. PATENT DOCUMENTS

| | | | | |
|---|---|---|---|---|
| 4,695,054 | A | 9/1987 | Tunstall | |
| 4,869,507 | A * | 9/1989 | Sahm | A63B 53/047 473/337 |
| 5,050,879 | A | 9/1991 | Sun | |
| 5,518,243 | A | 5/1996 | Redman | |
| 5,522,593 | A | 6/1996 | Kobayashi | |
| 5,629,475 | A * | 5/1997 | Chastonay | A63B 53/0466 73/65.03 |
| 5,776,010 | A | 7/1998 | Helmstetter | |
| 5,839,974 | A | 11/1998 | McAllister | |
| 6,077,171 | A * | 6/2000 | Yoneyama | A63B 60/00 473/291 |
| 6,149,534 | A | 11/2000 | Peters | |
| 6,264,571 | B1 | 7/2001 | Lekavich | |
| 6,409,612 | B1 | 6/2002 | Evans | |
| 6,458,044 | B1 | 10/2002 | Vincent et al. | |
| 6,592,468 | B2 | 7/2003 | Vincent | |
| 6,616,547 | B2 | 9/2003 | Vincent | |
| 6,663,505 | B1 | 12/2003 | Solari | |
| 6,811,496 | B2 | 11/2004 | Wahl | |
| 7,140,976 | B2 | 11/2006 | Chen | |
| 7,309,291 | B1 | 12/2007 | Bryant | |
| 7,819,757 | B2 | 10/2010 | Soracco et al. | |
| 8,133,129 | B2 | 3/2012 | Boyd | |
| 8,337,325 | B2 | 12/2012 | Boyd | |
| 8,454,453 | B2 | 6/2013 | Hettinger | |
| 8,579,724 | B2 | 11/2013 | Evans | |
| 8,740,722 | B2 | 6/2014 | Sato | |
| 8,915,797 | B1 | 12/2014 | Kuhar | |
| 9,149,706 | B2 | 10/2015 | Mudgett | |
| 9,555,299 | B2 | 1/2017 | Nakamura | |
| 9,987,532 | B2 | 6/2018 | Sander | |
| 10,065,094 | B2 | 9/2018 | Wallin | |
| 10,080,932 | B2 | 9/2018 | Demille | |
| 10,130,851 | B2 | 11/2018 | Milleman | |
| 10,137,341 | B2 | 11/2018 | Greer | |
| 10,155,143 | B2 | 12/2018 | Wahl | |
| 10,413,785 | B2 | 9/2019 | Akiyama | |
| 10,420,991 | B2 | 9/2019 | Petersen | |
| 10,661,128 | B2 | 5/2020 | Ripp | |
| 11,135,486 | B2 | 10/2021 | Higdon | |
| 11,253,758 | B2 * | 2/2022 | Huang | A63B 53/047 |
| 2002/0004427 | A1 * | 1/2002 | Cheng | A63B 53/04 473/338 |
| 2002/0032075 | A1 * | 3/2002 | Vatsvog | A63B 53/0487 473/334 |
| 2008/0153619 | A1 | 6/2008 | Tucker | |
| 2009/0239681 | A1 | 9/2009 | Sugimoto | |
| 2009/0291772 | A1 | 11/2009 | Boyd | |
| 2011/0039634 | A1 | 2/2011 | Tavares | |
| 2011/0092306 | A1 | 4/2011 | Lee | |
| 2011/0294597 | A1 | 12/2011 | Teramoto | |
| 2013/0324299 | A1 | 12/2013 | Clausen | |
| 2016/0346636 | A1 * | 12/2016 | Sander | A63B 53/047 |
| 2017/0080300 | A1 * | 3/2017 | Milleman | A63B 53/047 |
| 2017/0246517 | A1 * | 8/2017 | Ueda | A63B 53/047 |
| 2020/0276481 | A1 * | 9/2020 | Higdon | A63B 53/047 |

OTHER PUBLICATIONS

European Supplemental Search Report, EP20767428, Feb. 15, 2023.

* cited by examiner

MULTI-COMPONENT GOLF CLUB HEAD

RELATED APPLICATION DATA

This is a continuation of U.S. patent application Ser. No. 17/494,714, filed on Oct. 5, 2021, now U.S. Pat. No. 12,011,642, issued on Jun. 18, 2024, which is a continuation of U.S. patent application Ser. No. 16/806,855, filed on Mar. 2, 2020, now U.S. Pat. No. 11,135,486, issued on Oct. 5, 2021, which claims the benefit of U.S. Patent Application No. 62/812,803, filed on Mar. 1, 2019. The contents of all of which above are entirely incorporated herein by reference.

BACKGROUND

Golf club heads designed to concentrate mass in certain regions of the club head typically include external weight members received into external receptacles defined in exterior surfaces of the club head. These designs lack a 'look and feel' of a unitary club head construction (e.g., a forged-style club head). There is a need in the art for designs of golf clubs to customize weight allocation while retaining the aesthetics and feel of a tour iron.

Figure 1:
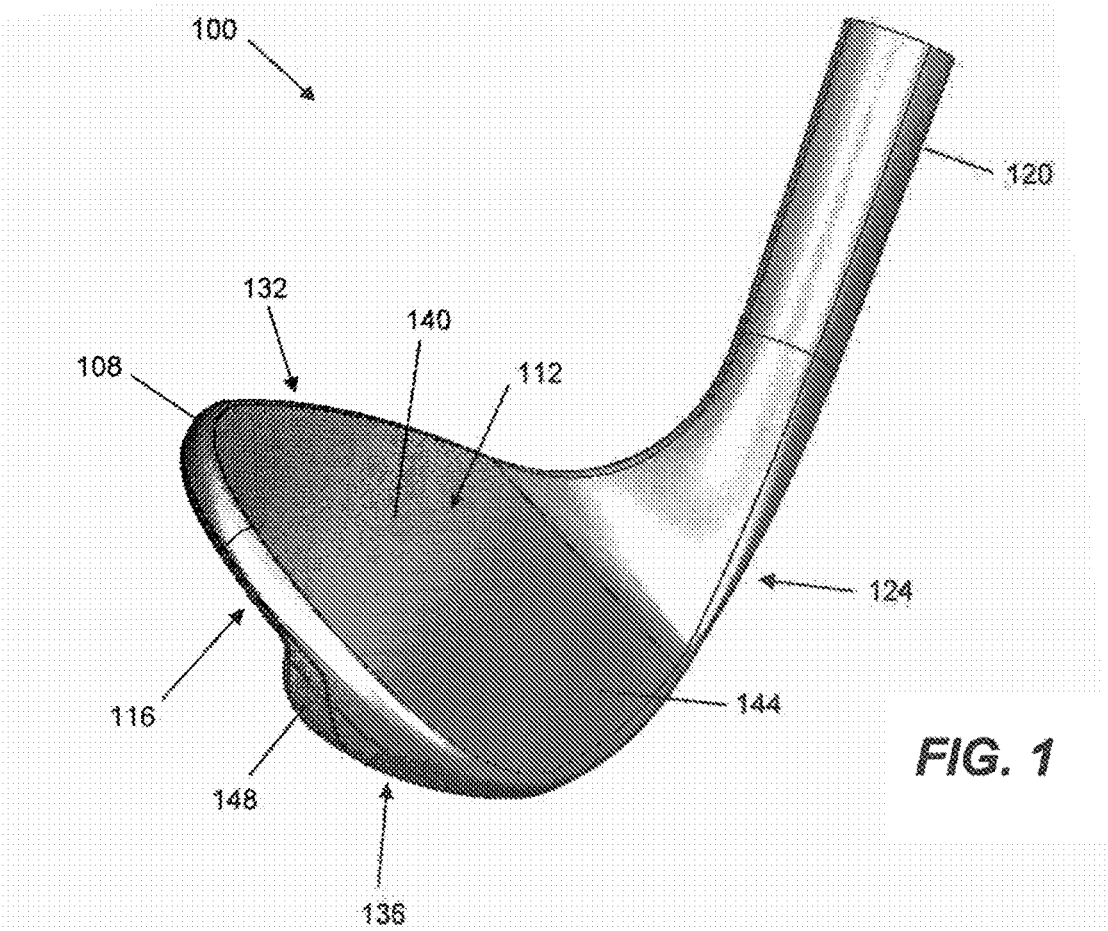
FIG. 1 is a front, toe-side perspective view of a golf club head.
Figure 2:
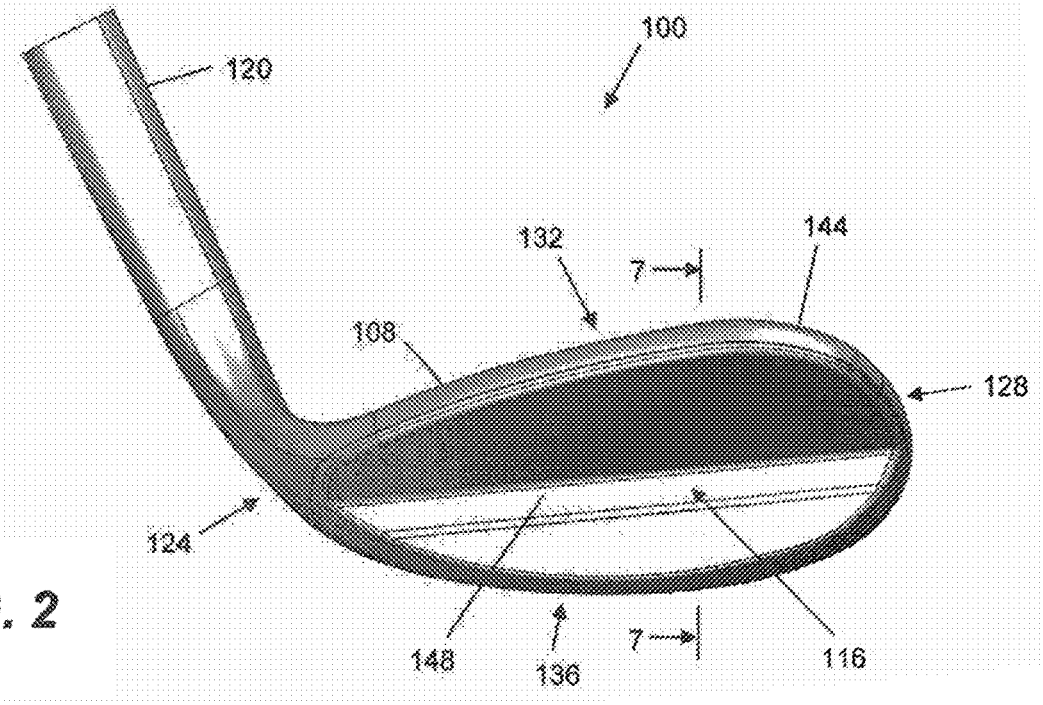
FIG. 2 is a back view of the golf club head of FIG. 1.
Figure 3:
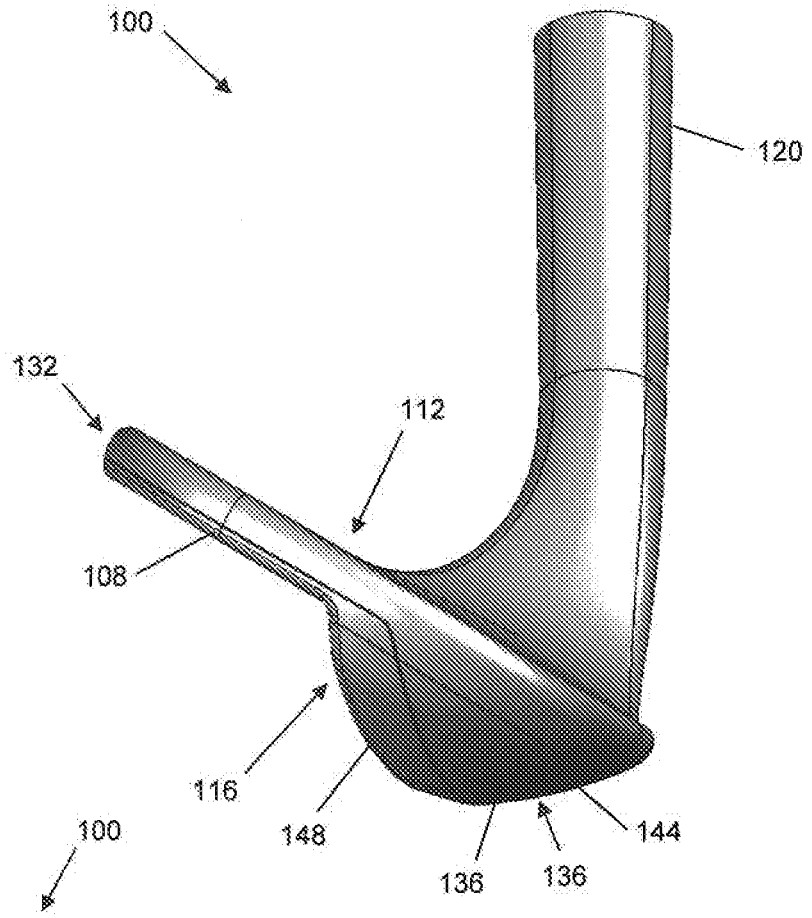
FIG. 3 is a toe-side view of the golf club head of FIG. 1.
Figure 4:
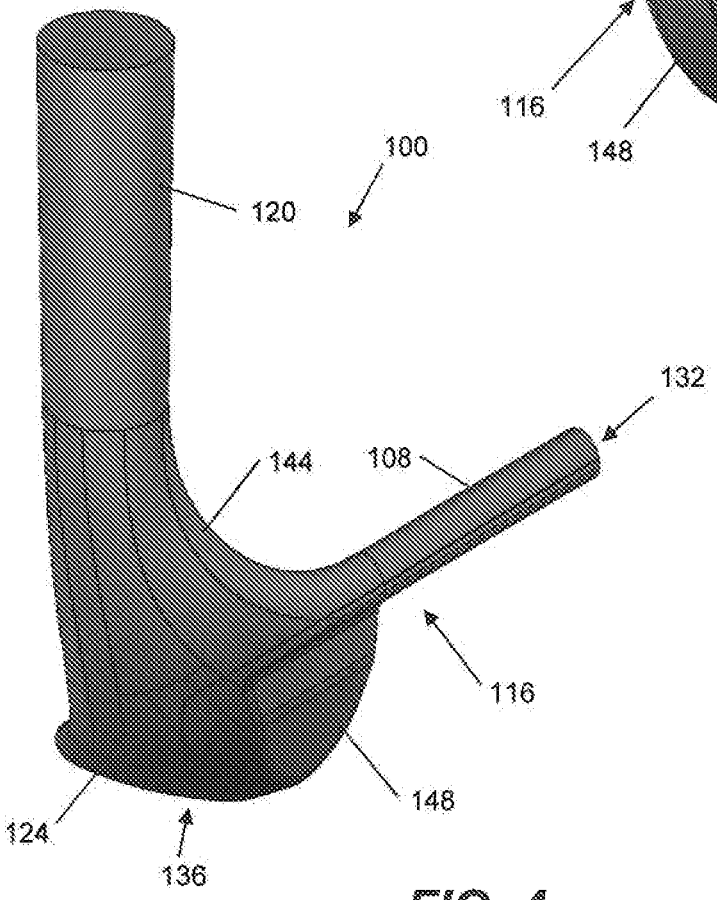
FIG. 4 is a heel-side view of the golf club head of FIG. 1.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in a physical, mechanical, or other manner.

DETAILED DESCRIPTION

Described herein is a golf club head including a body having a multi-component construction and one or more internal weight members. The club head includes a body formed from a front body joined to a rear body. The internal weight members are fully enclosed between the front and rear bodies. The club head design mimics the appearance of a club head of unitary construction (e.g., a forged club head), but provides an improved feel and improved swing characteristics (e.g., a low and away CG, a high MOI, etc.). The club head design also achieves superior adaptability as compared to a unitary construction club head. For example, the number, arrangement, and material properties (e.g., density) of the weight members are customizable at the time of manufacturing according to the particular preferences of a user. The internal weight member design also provides superior sound characteristics as compared to club heads having external weight members. For example, the internal weight member club design is not prone to the rattling that sometimes may occur when using externally weighted club heads. The size, shape, or material properties, or aesthetic properties of the front or the rear body can also be adjusted at the time of manufacturing to suit the particular preferences of the user, or to tailor the club head to particular playing conditions. For example, at the time of manufacturing, the user may select a particular rear body from a group of rear bodies of different sizes, shapes, material properties (e.g., density, strength, sound properties, etc.), or aesthetic properties (e.g., color, surface texture, visual patterns, etc.), where each of the differing rear bodies is compatible with the same front body to achieve a club head having particular desired performance and/or aesthetics characteristics.

FIGS. 1-8 illustrate a golf club head 100 that includes a multi-component construction and one or more internal weight members 104 according to embodiments of the present disclosure. In the illustrated embodiment, the club head 100 is an iron-type club head 100. However, the multi-component construction and internal weight member design is equally applicable to other types of club heads (e.g., drivers, woods, putters, hybrids, etc.). For example, as will be discussed below, FIGS. 9-16 illustrate a putter-type club head 200 that includes a multi-component construction and one or more internal weight members 204 according to another embodiment of the present disclosure.

Driver Loft Angle and Volume

In many embodiments, the loft angle of the club head is less than approximately 16 degrees, less than approximately 15 degrees, less than approximately 14 degrees, less than approximately 13 degrees, less than approximately 12 degrees, less than approximately 11 degrees, less than approximately 10 degrees, less than approximately 9 degrees, less than approximately 8 degrees, or less than approximately 7 degrees. The loft angle of the club can be between 7 degrees and 12 degrees.

Further, in many embodiments, the volume of the club head is greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400cc-600cc, 425cc-500cc, approximately 500cc-600cc, approximately 500cc-650cc, approximately 550cc-700cc, approximately 600cc-650cc, approximately 600cc-700cc, or approximately 600cc-800cc.

Fairway Wood Loft Angle and Volume

In many embodiments, the loft angle of the club head is less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head can be between 12 degrees and 35 degrees, between 15 degrees and 35 degrees, between 20 degrees and 35 degrees, or between 12 degrees and 30 degrees.

In many embodiments, the volume of the club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the club head can be approximately 150cc-200cc, approximately 150cc-250cc, approximately 150cc-300cc, approximately 150cc-350cc, approximately 150cc-400cc, approximately 300cc-400cc, approximately 325cc-400cc, approximately 350cc-400cc, approximately 250cc-400cc, approximately 250-350 cc, or approximately 275-375 cc.

Hybrid Loft Angle and Volume

In many embodiments, the loft angle of the club head is less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, the volume of the club head is less than approximately 200 cc, less than approximately 175 cc, less than approximately 150 cc, less than approximately 125 cc, less than approximately 100 cc, or less than approximately 75 cc. In some embodiments, the volume of the club head can be approximately 100cc-150cc, approximately 75cc-150cc, approximately 100cc-125cc, or approximately 75cc-125cc.

Iron Loft Angle

In many embodiments, the loft angle of the club head is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Wedge Loft Angle

In many embodiments, the loft angle of the club head is less than approximately 64 degrees, less than approximately 63 degrees, less than approximately 62 degrees, less than approximately 61 degrees, less than approximately 60 degrees, less than approximately 59 degrees, less than approximately 58 degrees, less than approximately 57 degrees, less than approximately 56 degrees, less than approximately 55 degrees, or less than approximately 54 degrees. Further, in many embodiments, the loft angle of the club head is greater than approximately 46 degrees, greater than approximately 47 degrees, greater than approximately 48 degrees, greater than approximately 49 degrees, greater than approximately 50 degrees, greater than approximately 51 degrees, or greater than approximately 52 degrees.

Putter Loft Angle

In many embodiments, the club head can have a loft angle less than 10 degrees. In many embodiments, the loft angle of the club head can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, or less than 5 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees.

With reference to FIGS. 1-4, the iron-type club head 100 includes a body 108 having a front end 112, a back end 116 opposite the front end 112, a hosel 120 for affixing the club head 100 to an end portion of a golf club shaft (not shown), a heel end 124 proximate the hosel 120, a toe end 128 opposite the heel end 124, a top rail 132, and a sole 136 opposite the top rail 132. In the illustrated embodiment, the front end 112 defines a striking surface or strikeface 140 spanning between heel end 124 and the toe end 128, and between the top rail 132 and the sole 136. In other embodiments, the club head 100 can include a separately constructed faceplate (not shown) that couples to the body 108 at the front end 112 and that defines the strikeface.

In many embodiments, the body 108 of the club head 100 includes two separately-formed components including a front body 144 and a rear body 148 joined to the front body 144. The front and rear bodies 144, 148 include corresponding first and second mating surfaces 152, 156 (FIGS. 5 and 6) which contact and engage one another to join the rear body 148 to the front body 144. The rear body 148 can be attached to the front body 144 via epoxy, glue, swedging, welding (e.g., laser welding, plasma welding, etc.), mechanical fastening, or any other suitable method. In many embodiments, the front body 144 defines at least some of the regions of the overall body 108 (e.g., the front end, the top rail, etc.), while the rear body 148 defines the same or other regions of the body 108 (e.g., the back end, the heel, etc.). In the illustrated embodiment, the front body 144 defines the front end 112 including the strikeface 140, the hosel 120, and portions of the heel end 124, the toe end 128, the top rail 132, and the sole 136. Meanwhile, the rear body 148 defines the back end 116, and portions of the heel end 124, the toc end 128, the top rail 132, and the sole 136. Thus, as will be discussed below, the dimensions of one or more regions of the body 108 (e.g., the sole 136) may be customized according to the needs of a particular user, or to the conditions of a particular golf course, by varying the size or shape of one or the other of the front body 144 and the rear body 148.

The corresponding first and second mating surfaces 152, 156 can comprise a width measured in a heel-to-toe direction. The width of the first and second mating surfaces 152, 156 can vary between approximately 2.5 inches and 4.5 inches. In many embodiments, the width of a portion of the first and second mating surfaces 152, 156 can be approximately 2.5 inches-2.75 inches, 2.75 inches-3.0 inches, 3.0 inches-3.25 inches, 3.25 inches-3.5 inches, 3.5 inches-3.75 inches, 3.75 inches-4.0 inches, 4.0 inches-4.25 inches, or 4.25 inches-4.5 inches. The width of the first and second mating surfaces 152, 156 can be 2.5, 2.75 3.0, 3.25, 3.50, 3.75, 4.0, 4.25, or 4.5 inches.

Figure 5:
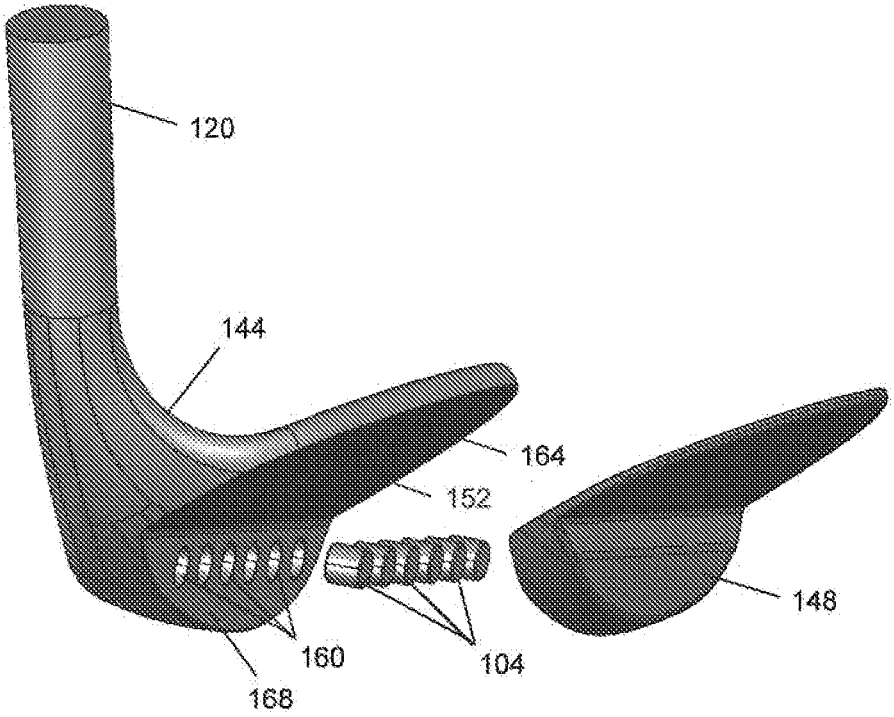
FIG. 5 is a back, heel-side exploded perspective view of the golf club head of FIG. 1.
Figure 6:
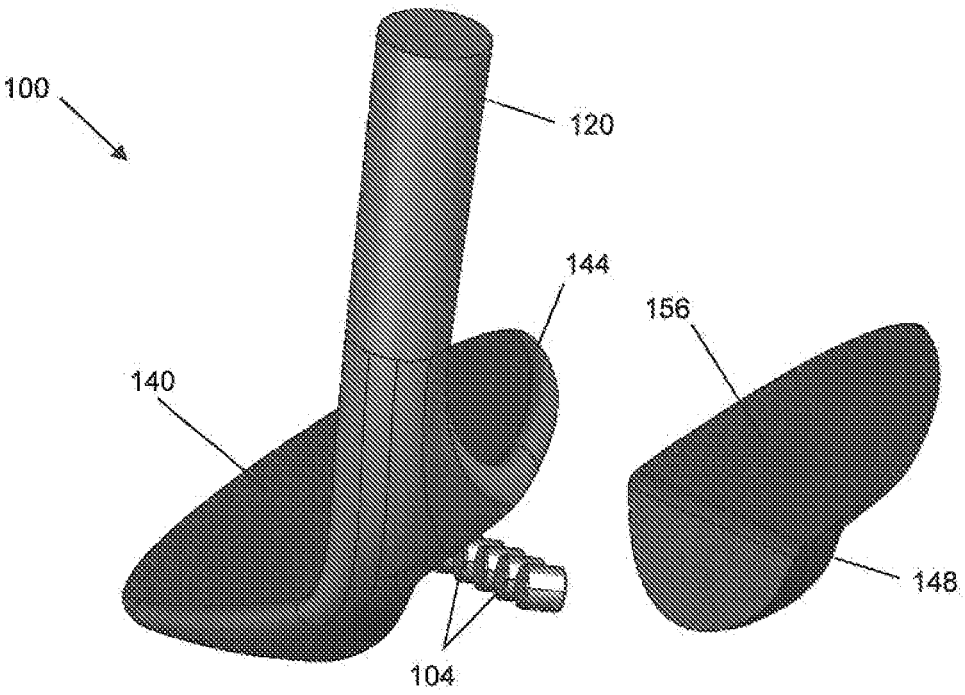
FIG. 6 is a front, heel-side exploded perspective view of the golf club head of FIG. 1.

With reference to FIGS. 5 and 6, the club head 100 also includes the one or more internal weight members 104 enclosed within the body 108 between the front and rear bodies 144, 148. The weight members 104 are formed from a material having a relatively greater density than that of the materials forming the front body 144 and the rear body 148. Internal weight receptacles 160 are defined in one or both of the first mating surface 152 or the second mating surface 156 and selectively receive the one or more weight members 104 (i.e. threadable engagement, press fit, etc.). In the illustrated embodiment, the weight receptacles 160 are defined within the first mating surface 152 of the front body 144. The weight members 104 can be secured within the weight receptacles 160 via epoxy, glue, force-fit, mechanical fastening, or any other suitable method. The front and rear bodies 144, 148 are joined at the mating surfaces 152, 156 to enclose and secure the weight members 104 within the combined body 108. In the illustrated embodiment, each weight receptacle 160 receives a corresponding weight member 104 (i.e., the number of weight members 104 corresponds to the number of weight receptacles 160). In other embodiments, some of the weight receptacles 160 may receive a weight member 104, while others of the weight receptacles 160 may remain empty.

Figure 7:
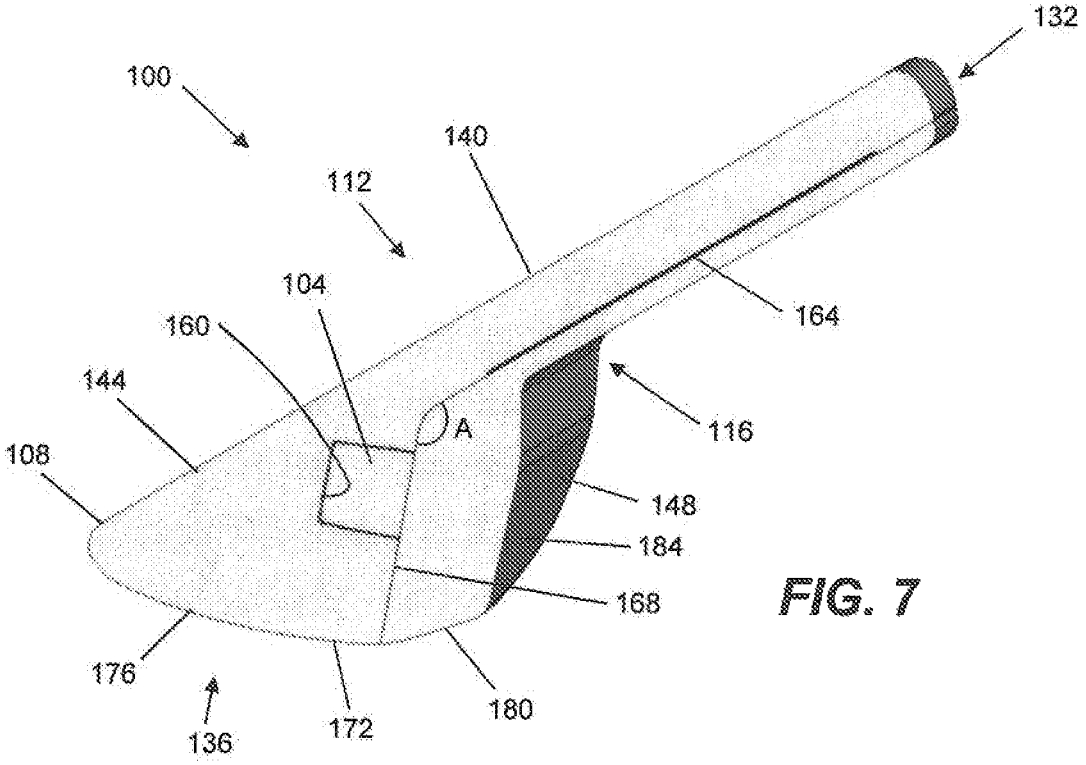
FIG. 7 is a cross-sectional view of the golf club head of FIG. 1 taken along line 7-7 of FIG. 2.

In the illustrated embodiment, the front body 144 defines six weight receptacles 160 that receive six corresponding weight members 104. In other embodiments, the club head 100 may include fewer or more than six weight receptacles 160 (e.g., one, two, three, four, five, seven, eight, or more than eight weight receptacles) for receiving fewer or more than six corresponding weight members 104 (e.g., one, two, three, four, five, seven, eight, or more than eight weight members). As shown, all of the illustrated weight receptacles 160 and weight members 104 are cylindrical and have approximately the same respective shapes and volumes. In other embodiments, the weight receptacles 160 can vary in volume and can be spherical, conical, frustoconical, cylindrical, rectangular, or any other suitable geometry, including combinations thereof. The weight members 104 can likewise vary in volume and can be spherical, conical, frustoconical, cylindrical, rectangular, or any other suitable geometry corresponding to the volume and shape of each respective weight receptacle 160. The weight members 104 can each be formed of the same material, some of the weight members can be formed of differing materials having differing material properties (e.g., density, hardness, etc.). In alternative embodiments, the rear body 148 can further define interior weight receptacles (not external weight receptacles) that can receive one or more weight members. This creates a rearward CG that resembles golf club heads with external weight members while maintaining a unitary construction appearance. With reference to FIG. 7, the first mating surface 152 of the front body 144 is divided into generally planar upper and lower first mating surfaces 164, 168 defining a mating surface angle A therebetween. In the illustrated embodiment, the mating surface angle A is approximately 130 degrees. In other embodiments, the mating surface angle A can be between approximately 60 degrees and 175 degrees. For example, the mating surface angle A can be approximately 60, 75, 90, 100, 110, 115, 120, 125, 130, 135, 140, 145, 150, 160, or 175 degrees.

The upper first mating surface 164 is located closer to the top rail 132 and extends generally parallel to the strikeface 140. In other embodiments, the upper first mating surface 164 may not be parallel to the strikeface 140, such that the upper first mating surface 164 defines an acute angle with respect to the strikeface 140. The lower first mating surface 168 is located closer to the sole 136 and defines an acute angle with respect to the strikeface 140. In the illustrated embodiment, the weight receptacles 160 are defined within the lower first mating surface 168. Each weight member 104 can be positioned within its respective weight receptacle 160 such that the one side of the weight member 104 is flush with the first mating surface 152. The weight receptacles 160 and weight members 104 can be perpendicular or near perpendicular to the first mating surface 152. The weight receptacles 160 can be aligned within a single plane that forms an acute angle with the strikeface 140 near to the sole 136.

When installed into the weight receptacles 160, the weight members 104 are located closer to the sole 136 than to the top rail 132. This tends to lower the CG of the club head 100 toward the sole 136. In other embodiments (not shown), the weight receptacles may instead be defined in the second mating surface 156 of the rear body 148, such that the installed weight members 104 are located relatively further from the strikeface 140 and tend to move the CG away from the strikeface 140.

The upper first mating surface 164 and lower first mating surface 168 can comprise a width measured in a heel-to-toe direction and a height measured in a top rail-to-sole direction. The width of the upper first mating surface 164 and lower first mating surface can vary between approximately 2.5 inches and 4.5 inches. In many embodiments, the width of a portion of the upper first mating surface 164 and lower first mating surface 168 can be approximately 2.5 inches-2.75 inches, 2.75 inches-3.0 inches, 3.0 inches-3.25 inches, 3.25 inches-3.5 inches, 3.5 inches-3.75 inches, 3.75 inches-4.0 inches, 4.0 inches-4.25 inches, or 4.25 inches-4.5 inches. The width of a portion of the upper first mating surface 164 and lower first mating surface 168 can be 2.5 inches, 2.75 inches, 3.0 inches, 3.25 inches, 3.5 inches, 3.75 inches, 4.0 inches, or 4.25 inches.

The height of the corresponding upper first mating surface 164 can vary between approximately 1 inch and 3 inches. In many embodiments, the height of a portion of the upper first mating surface 164 can be between approximately 1 inch-1.5 inches, 1.5 inches-2 inches, 2.5 inches-3 inches. In alternative embodiments, the height of a portion of the upper first mating surface 164 can be approximately 1 inch, 1.5 inches, 2 inches, 2.5 inches, or 3 inches.

The lower first mating surface 168 can comprise a height measured in a generally top rail-to-sole direction. The height of the lower first mating surface 168 can vary between approximately 0.1 inch and 1 inch. In many embodiments, the height of a portion of the lower first mating surface 168 can be approximately 0.1 inch-0.2 inch, 0.2 inch-0.3 inch, 0.3 inch-0.4 inch, 0.4 inch-0.5 inch, 0.5 inch-0.6 inch, 0.6 inch-0.7 inch, 0.7 inch-0.8 inch, 0.8 inch-0.9 inch, or 0.9 inch-1.0 inch. In other embodiments, the height of a portion of the lower first mating surface 168 can be 0.2-inch, 0.3 inch, 0.4 inch, 0.5 inch, 0.6 inch, 0.7 inch, 0.8 inch, 0.9 inch, or 1.0 inch.

The front body 144 is made of a relatively denser material than that of the rear body 148. In the illustrated embodiment, the front body 144 is made of 17-4 stainless steel. In other embodiments, the front body 144 of the club head 100 can be made of any of one or combination of the following: titanium, aluminum, tungsten, another steel alloy (e.g. 455 steel, 475 steel, 431 steel, 8620 alloy steel, S25C steel, carbon steel, maraging steel, stainless steel, stainless steel alloy, etc.), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, the front body 144 can be formed of carpenter grade 455 steel, carpenter grade 475 steel, C300 steel, C350 steel, a Ni—Co—Cr steel alloy, a quench and tempered steel alloy, or 565 steel. The front body 144 can be formed by any one or combination of the following methods: forging, casting, co-casting, die-casting, milling, 3-D printing, or any other method suitable for making a golf club head.

In many embodiments, the density of the front body 144 can be between approximately 1% to approximately 300% greater than the density of the rear body 148. For example, the density of the front body 144 can be 1%-5%, 5%-10%, 10%-15%, 15%-20%, 20%-25%, 25%-30%, 30%-35%, 35%-40%, 40%-45%, 45%-50%, 50%-55%, 55%-60%, 60%-65%, 65%-70%, 70%-75%, 75%-80%, 80%-85%, 85%-90%, 90%-100%, 100%-105%, 105%-110%, 110%-115%, 115%-120%, 120%-125%, 125%-130%, 130%-135%, 135%-140%, 140%-145%, 145%-150%, 150%-155%, 155%-160%, 160%-165%, 165%-170%, 170%-175%, 175%-180%, 180%-185%, 185%-190%, 190%-200%, 200%-205%, 205%-210%, 210%-215%, 215%-220%, 220%-225%, 225%-230%, 230%-235%, 235%-240%, 240%-245%, 245%-250%, 250%-255%, 255%-260%, 260%-265%, 265%-270%, 270%-275%, 275%-280%, 280%-285%, 285%-290%, or 290%-300% greater than the density of the rear body 148. In alternative embodiments, the density of the front body 144 can be greater than approximately 10%, approximately 20%, approximately 30%, approximately 40%, approximately 50%, approximately 60%, approximately 70%, approximately 80%, approximately 90%, approximately 100%, approximately 110%, approximately 120%, approximately 130%, approximately 140%, approximately 150%, approximately 160%, approximately 170%, approximately 180%, approximately 190%, approximately 200%, approximately 210%, approximately 220%, approximately 230%, approximately 240%, approximately 250%, approximately 260%, approximately 270%, approximately 280%, approximately 290%, or approximately 300% greater than the rear body 148.

The rear body 148 is made of a relatively less dense material than that of the front body 144. In the illustrated embodiment, the rear body 148 is made of a composite material such as thermoplastic composite ("TPC") (e.g., DuPont™ Vizilon® TPC, thermoplastic polyurethane, etc.). In other embodiments, the rear body 148 of the club head 100 can be made of any of one or combination of the following: titanium, aluminum, tungsten, another steel alloy (e.g. 455 steel, 475 steel, 431 steel, 8620 alloy steel, S25C steel, carbon steel, maraging steel, stainless steel, stainless steel alloy, etc.), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, the rear body 148 can be formed of carpenter grade 455 steel, carpenter grade 475 steel, C300 steel, C350 steel, a Ni—Co—Cr steel alloy, a quench and tempered steel alloy, or 565 steel. The rear body 148 can be formed by any one or combination of the following methods: forging, casting, co-casting, die-casting, milling, 3-D printing, or any other method suitable for making a golf club head. In other embodiments, the rear body 148 may be made of the same material as that of the front body 144.

The weight members 104 are made of a relatively denser material than those of the front and rear bodies 144, 148. In the illustrated embodiment, the weight members 104 are made of tungsten. In other embodiments, the weight members 104 can be made of any of one or combination of the following: titanium, aluminum, tungsten, another steel alloy (e.g. 455 steel, 475 steel, 431 steel, 8620 alloy steel, S25C steel, carbon steel, maraging steel, stainless steel, stainless steel alloy, etc.), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, the weight members 104 can be formed of carpenter grade 455 steel, carpenter grade 475 steel, C300 steel, C350 steel, a Ni—Co—Cr steel alloy, a quench and tempered steel alloy, or 565 steel.

The number, composition, or arrangement of the weight members 104 can be strategically varied to achieve a desired weight of the golf club head 100 or to achieve a desired swing characteristic of the golf club head 100. That is, the overall weight, the distribution of weight, the center of gravity ("CG"), and/or the moment of inertia ("MOI") of the club head 100 can be customized according to user preference and to specific playing conditions by varying the number, composition, or arrangement of the weight members 104 installed within the weight receptacles 160. For example, in some embodiments, some of the weight receptacles 160 located proximate the heel and toe ends 124, 128 may receive respective weight members 104, while the remaining, centrally-located weight receptacles 160 may remain unoccupied. In such embodiments, as compared to a club head in which all of the weight receptacles are uniformly occupied, the MOI may be relatively increased due to relatively more weight being distributed in perimeter regions of the club head 100, while the overall weight of the club head 100 may be relatively decreased. As another example, in some embodiments, some of the weight receptacles 160 located proximate the heel and toe ends 124, 128 may receive weight members 104 of relatively smaller sizes or made of relatively less dense materials, while the remaining, centrally-located weight receptacles 160 may receive weight members 104 of relatively greater sizes or made of relatively higher density materials. Such an arrangement would tend to decrease the MOI due to relatively more weight being distributed in the central region of the club head 100, and would also tend to increase the overall weight of the club head 100. As another example, in some embodiments, some of the weight receptacles 160 located proximate the toe end 128 may be occupied while other weight receptacles 160 located proximate the heel end 124 may remain unoccupied. Such an arrangement would tend to shift the CG of the club head 100 toward the toc end 128.

With continued reference to FIG. 7, the sole 136 of the body 108 defines a sole surface 172 extending between the toe end 128 and the heel end 124, and between the strikeface 140 and the back end 116. The sole surface 172 includes a front sole surface portion 176 defined by the front body 144, and a rear sole surface portion 180 defined by the rear body 148. The front sole surface portion 176 extends generally from the strikeface 140 to the first mating surface 152 (specifically, to the lower first mating surface 168). The rear sole surface portion 180 extends generally from the second mating surface 156 to a rear surface 184 defined by the back end 116.

Figure 8:
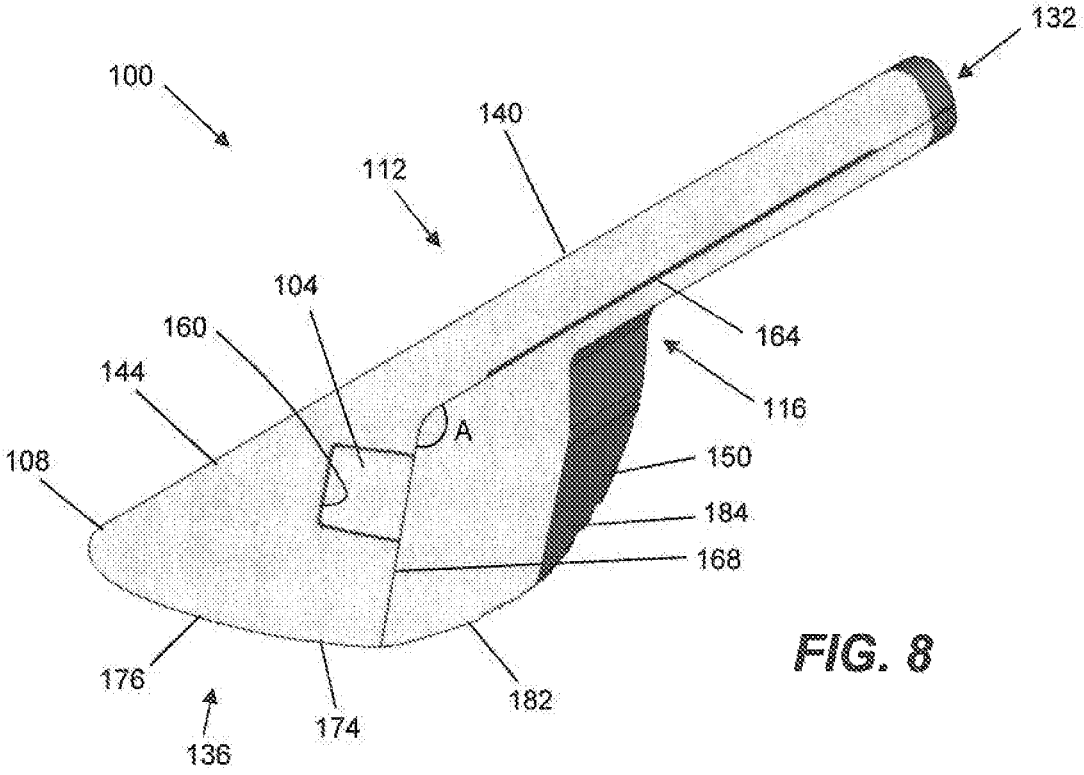
FIG. 8 is another cross-sectional view of the golf club head of FIG. 1 taken along line 7-7 of FIG. 2.
Figure 9:
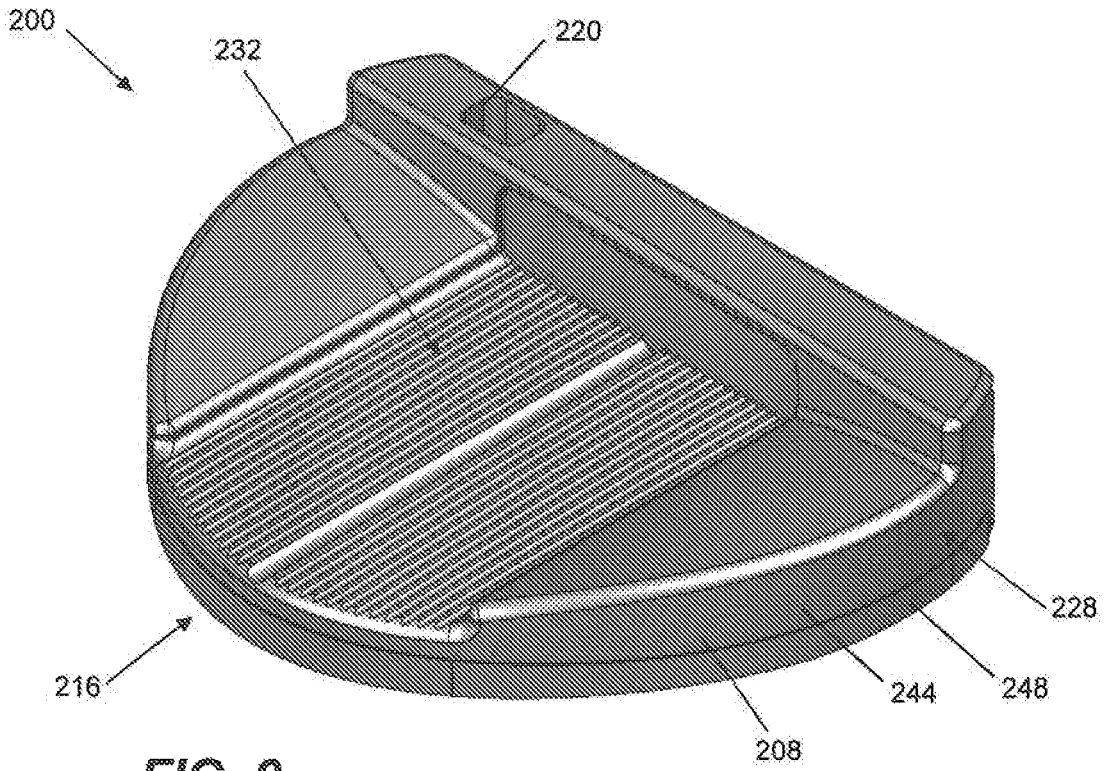
FIG. 9 is a back, toe-side perspective view of another golf club head.
Figure 10:
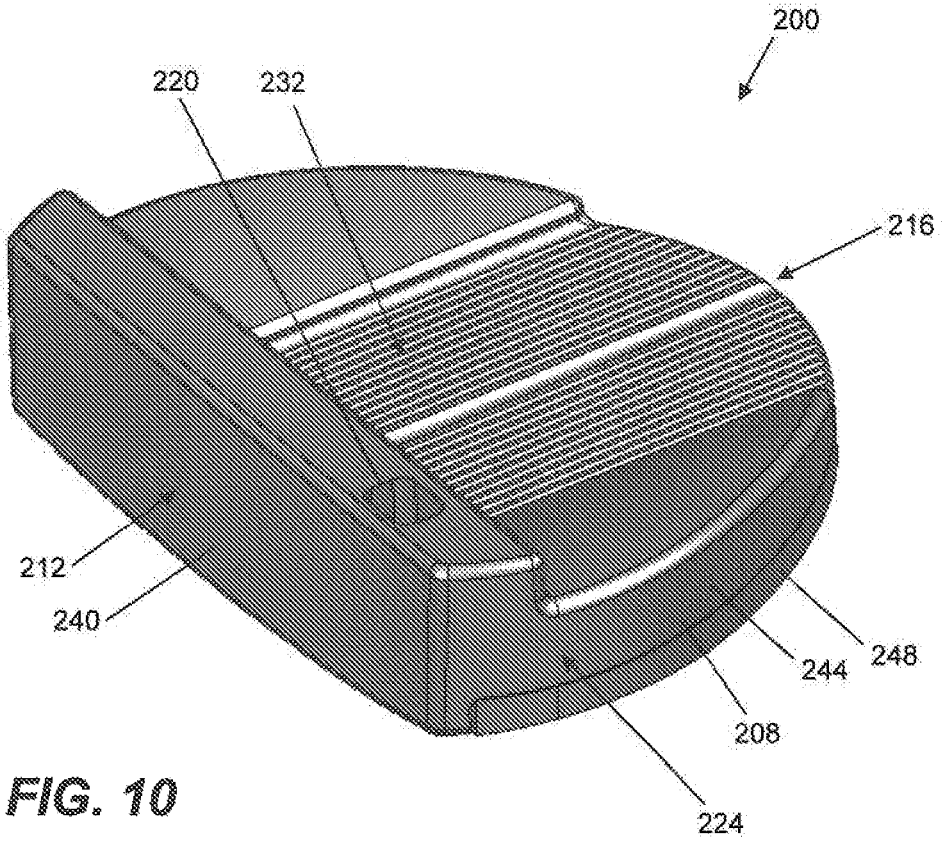
FIG. 10 is a front, heel-side perspective view of the golf club head of FIG. 9.
Figure 11:
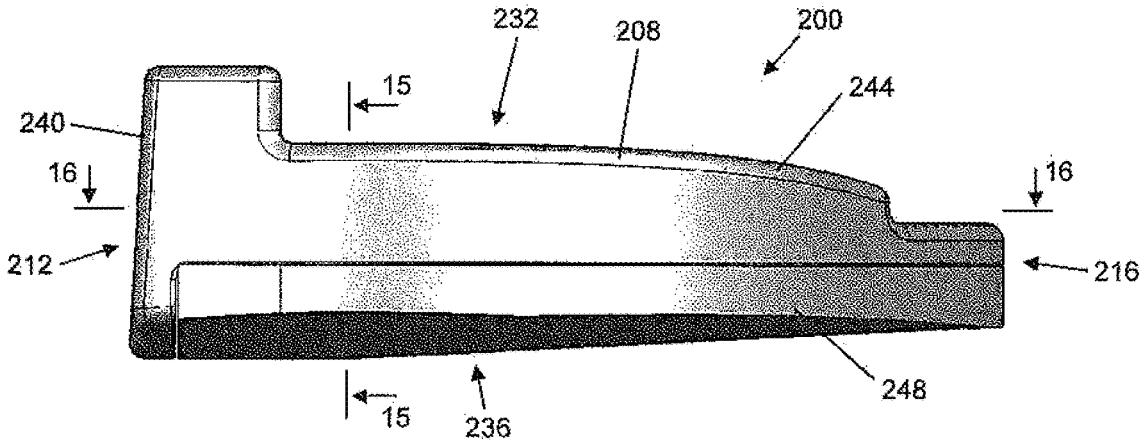
FIG. 11 is a heel-side view of the golf club head of FIG. 9.
Figure 12:
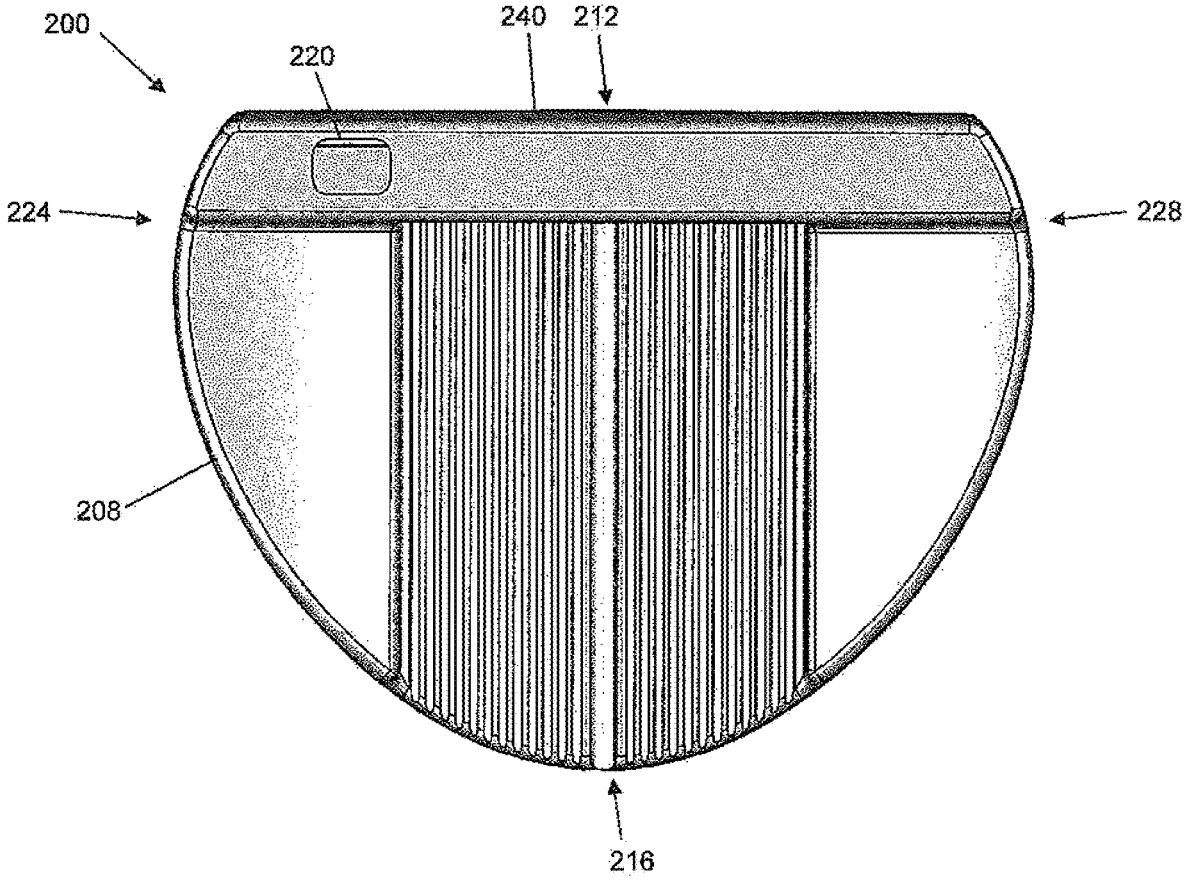
FIG. 12 is a top view of the golf club head of FIG. 9.

FIG. 8 illustrates another rear body 150 that can be used in the golf club head 100 in place of the rear body 148. The rear body 150 includes many of the same features as the rear body 148, except that the rear body 150 has a relatively larger size and includes a modified rear sole surface portion 182 having a relatively greater extent between the second mating surface 156 and the rear surface 184, as compared to the rear body 148 described above. Accordingly, when coupled to the front body 144 as shown in FIG. 8, the rear body 150 contributes to a larger sole surface 174 (i.e., having a greater area) as compared to the sole surface 172 illustrated in FIG. 7. The rear body 150 may be formed of the same material as that of the rear body 148 (e.g., thermoplastic composite), and front body 144 may be formed of a different, denser material than that of the rear bodies 148, 150. Increasing or creating a larger sole surface 172 (when compared to FIG. 7) creates a golf club head 100 more oriented to a game improvement type-club head without the need for a large and/or deep cavity (i.e. devoid of a cavity).

For example, the rear sole surface portion 180, 182 can form up to 50% of the sole surface 172, 174. In many embodiments, the rear sole surface portion 180, 182 can form between 0%-5%, 5%-10%, 10%-15%, 15%-20%, 20%-25%, 25%-30%, 30%-35%, 35%-40%, 40%-45%, or 45%-50% of sole surface 172, 174. In alterative embodiments, the rear sole surface portion 180, 182 can form less than 50%, less than 45%, less than 40%, less than 35%, less than 30%, less than 25%, less than 20%, less than 15%, less than 10%, or less than 5% of the sole surface portion 172, 174.

In this regard, the club head 100 including the rear body 148 (FIG. 7) may be better suited to harder or more compacted playing surfaces (e.g., golf courses located in desert climates). The relatively smaller area of the resulting sole surface 172 allows the club head 100 to cut into the playing surface to an appropriate depth during a golf swing without bouncing too hard off of the relatively compacted ground. On the other hand, the club head 100 including the rear body 150 (FIG. 8) may be better suited to softer or more saturated playing surfaces (e.g., golf courses located in wet or marshy climates). The relatively larger area of the resulting sole surface 174 allows the club head 100 to cut into the playing surface to an appropriate depth during a golf swing without sinking too deep into the relatively soft ground. Since the rear bodies 148, 150 are each made of a material that is less dense than that of the front body 144, and the weight members 104 are carried in the front body 144, the difference in size between the rear bodies 148, 150 has a relatively muted effect on the overall weight, weight distribution, CG location, and MOI of the club head 100.

In addition to the size and shape, aesthetic features of the front and/or rear bodies 144, 148 may also be customized at the time of manufacturing of the club head 100. For example, a user can select from a number of aesthetic options including different colors, surface patterns, textures, etc. of the front and rear bodies 144, 148 to create different club head combinations.

By enclosing the weight members 104 between the front and rear bodies 144, 148, the club head 100 mimics the appearance of a unitary construction club head (e.g., a forged club head) while also achieving the improved feel, swing characteristics (e.g., high MOI, etc.), and adaptability afforded by the customizable weight members 104. The weight members 104 and weight receptacles 160 allow the golf club head 100 to be adapted and customized during manufacturing but appear to be unitary in construction at the time of use. The golf club head 100 also achieves superior sound characteristics as compared to club heads having external weight members or mechanically fastened weight members, since the enclosed weight members 104 do not rattle within external holes. Further, the enclosed weights present beneficial cost advantages as the weight members 104 can merely be bar stock, rather than needing to be polished or finished as generally required by external weight members.

FIGS. 9-16 illustrate another golf club head 200 that includes a multi-component construction and one or more internal weight members 204 according to other embodiments of the present disclosure. The club head 200 is a putter-type club head. The club head 200 is similar to the club head 100 and includes much of the same structure as the club head 100. Accordingly, the following description focuses primarily on the structure and features that are different from the embodiments described above in connection with FIGS. 1-8. Features and elements that are described above in connection with FIGS. 1-8 are numbered in the 200 series of reference numerals in FIGS. 9-16. It should be understood that the features of the club head 200 that are not explicitly described below have the same properties as the features of the club head 100.

With reference to FIGS. 9-12, the putter-type club head 200 includes a body 208 having a front end 212, a back end 216 opposite the front end 212, a hosel opening 220 for affixing the club head 200 to an end portion of a golf club shaft (not shown), a heel end 224 proximate the hosel opening 220, a toe end 228 opposite the heel end 224, a top end or crown 232, and a sole 236 opposite the crown 232. In the illustrated embodiment, the front end 212 defines a striking surface or strikeface 240 spanning between heel end 224 and the toe end 228, and between the crown 232 and the sole 236. In other embodiments, the club head 200 can include a separately constructed faceplate (not shown) that couples to the body 208 at the front end 212 and that defines the strikeface.

In many embodiments, the body 208 of the club head 200 includes two separately-formed components including a front body 244 and a rear body 248 joined to the front body 244. The front and rear bodies 244, 248 include corresponding first and second mating surfaces 252, 256 (FIGS. 13 and 14) which contact and engage one another to join the rear body 248 to the front body 244. The rear body 248 can be attached to the front body 244 via epoxy, glue, swedging, welding (e.g., laser welding, plasma welding, etc.), mechanical fastening, or any other suitable method. In many embodiments, the front body 244 defines at least some of the regions of the overall body 208 (e.g., the front end, the crown, etc.), while the rear body 248 defines the same or other regions of the body 208 (e.g., the back end, the sole, etc.). In the illustrated embodiment, the front body 244 defines the front end 212 including the strikeface 240, the hosel opening 220, the crown 232, and portions of the heel end 224, the toe end 228, and the back end 216. Meanwhile, the rear body 248 defines much of the sole 236 and portions of the heel end 224, the toe end 228, and the back end 216. Thus, the dimensions of one or more regions of the body 208 (e.g., the sole 236) may be customized according to the needs of a particular user, or to the conditions of a particular golf course, by varying the size or shape of one or the other of the front body 244 and the rear body 248.

Figure 13:
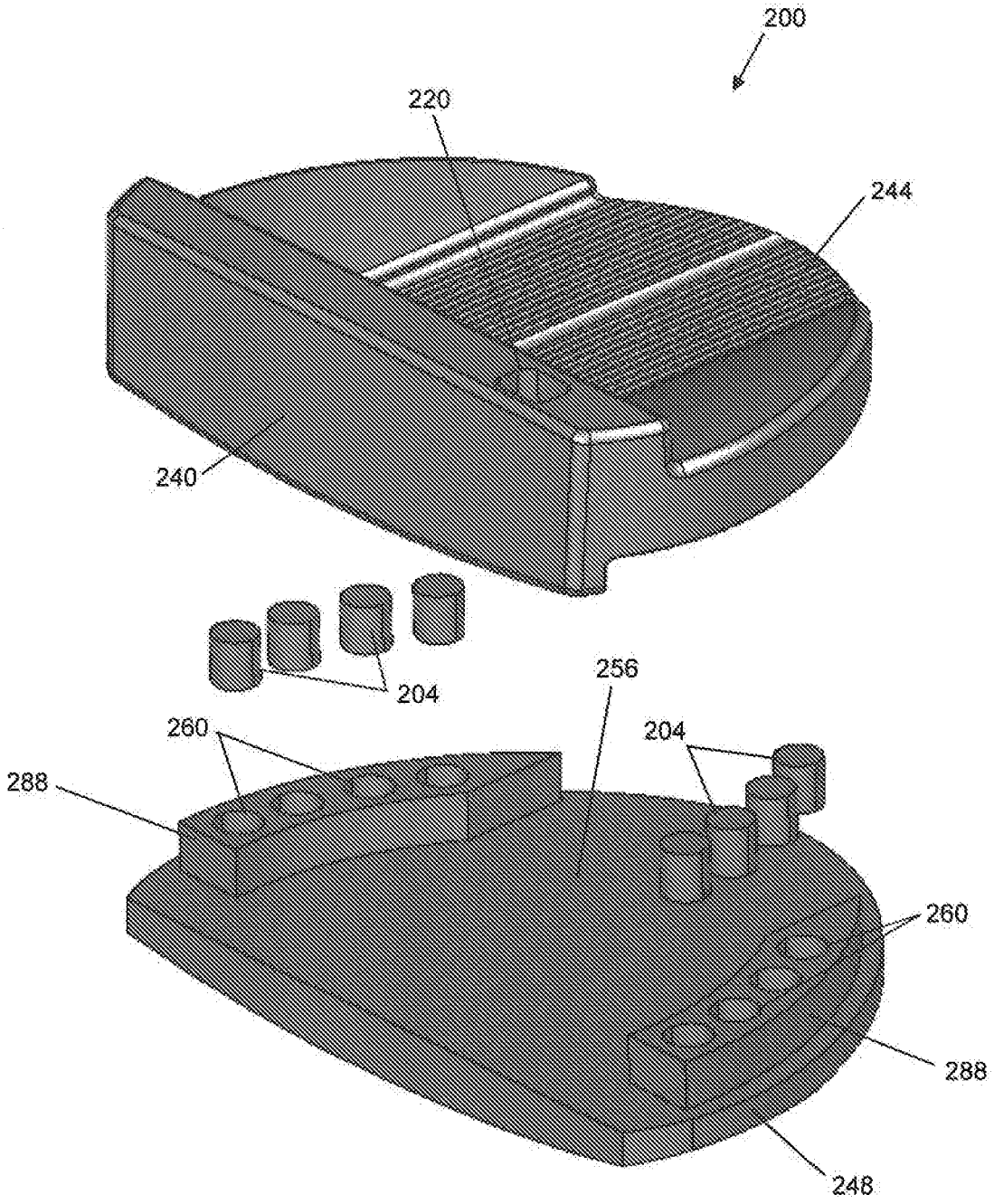
FIG. 13 is a front, heel-side exploded perspective view of the golf club head of FIG. 9.
Figure 14:
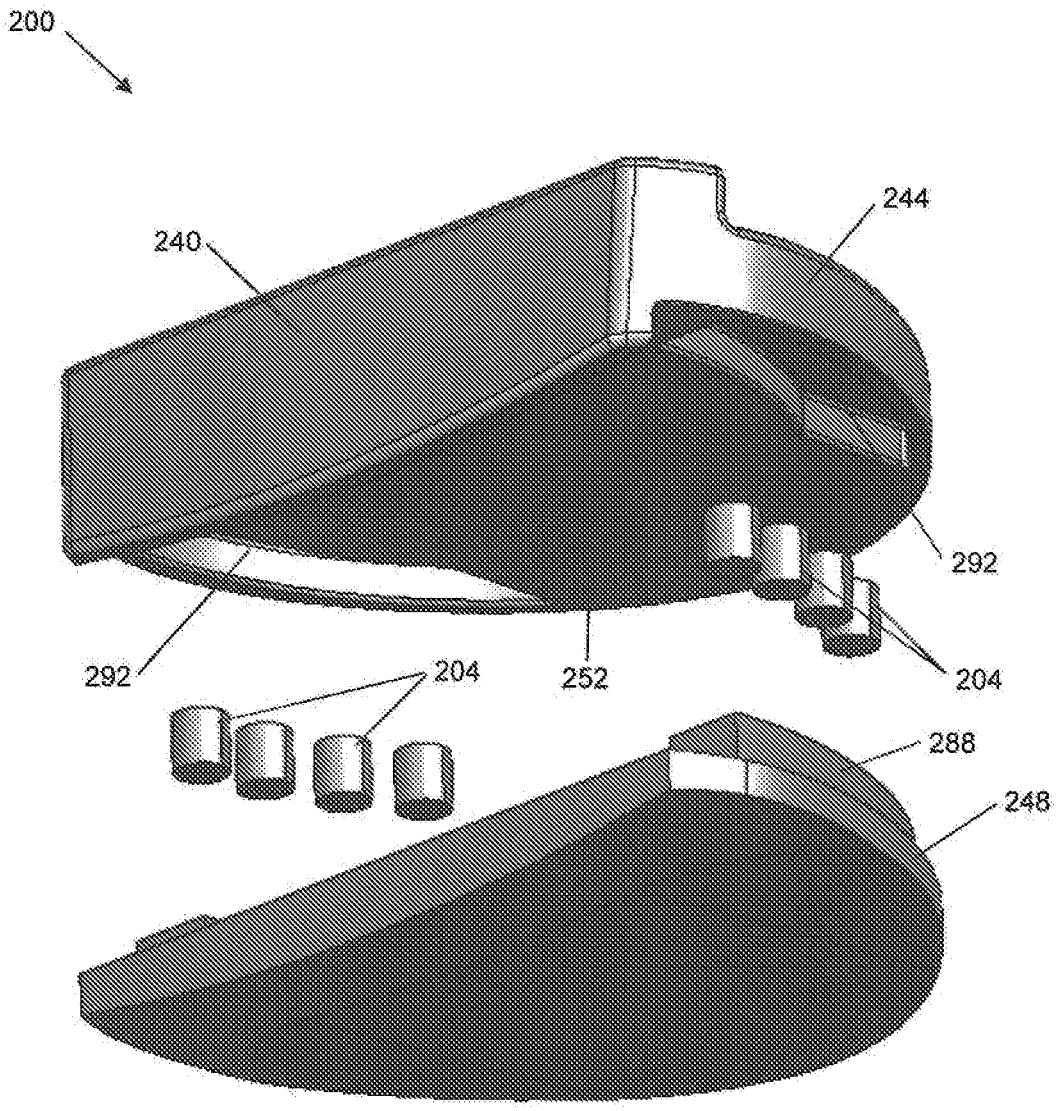
FIG. 14 is another front, heel-side exploded perspective view of the golf club head of FIG. 9.
Figure 15:
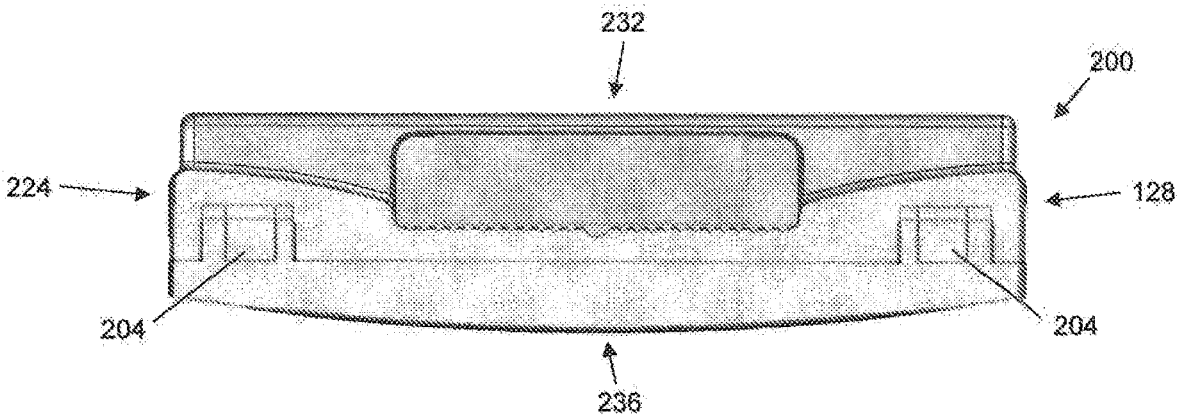
FIG. 15 is a cross-sectional view of the golf club head of FIG. 9 taken along line 15-15 of FIG. 11.
Figure 16:
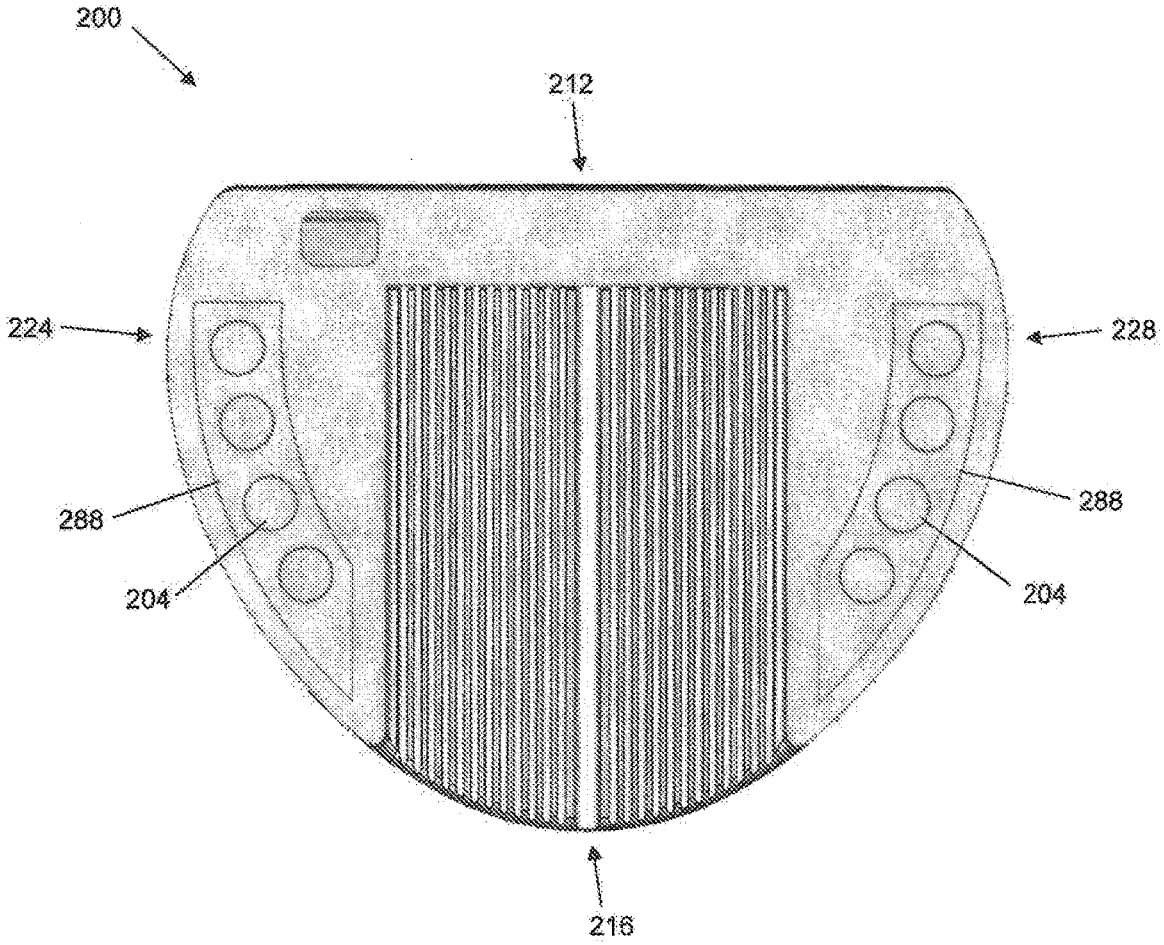
FIG. 16 is another cross-sectional view of the golf club head of FIG. 9 taken along line 16-16 of FIG. 11.

With reference to FIGS. 13 and 14, the club head 200 also includes the one or more internal weight members 204 enclosed within the body 208 between the front and rear bodies 244, 248. The weight members 204 are formed from a material having a relatively greater density than that of the materials forming the front body 244 and the rear body 248. In the illustrated embodiment, the rear body 248 includes a pair of receptacle banks 288 protruding upward from the second mating surface 256. Specifically, one receptacle bank 288 is located proximate each of the heel end 288 and the toe end 288, respectively, and each receptacle bank 288 extends generally lengthwise between the front end 288 and the back end 288. Internal weight receptacles 260 are defined in each receptacle bank 288 to selectively receive the weight members 204. The weight members 204 can be secured within the weight receptacles 260 via epoxy, glue, force-fit, mechanical fastening, or any other suitable method.

The front body 244 includes a pair of recesses 292 corresponding to the receptacle banks 288, and each recess 292 receives the corresponding receptacle bank 288 when the rear body 248 is coupled to the front body 244. In other embodiments, the receptacle banks 288 including the weight receptacles 260 may instead be provided on the front body 244, and may protrude downward from the first mating surface 252. Likewise, the rear body 248 may instead include the recesses 292 to receive the receptacle banks 288 when the front and rear bodies 244, 248 are coupled together. The front and rear bodies 244, 248 are joined at the mating surfaces 252, 256 to enclose and secure the weight members 204 within the combined body 208. In the illustrated embodiment, each weight receptacle 260 receives a corresponding weight member 204 (i.e., the number of weight members 204 corresponds to the number of weight receptacles 260). In other embodiments, some of the weight receptacles 260 may receive a weight member 204, while others of the weight receptacles 260 may remain empty.

In the illustrated embodiment, the front body 244 includes four weight receptacles 260 defined in each receptacle bank 288 (for a total of eight weight receptacles 260). The eight illustrated weight receptacles 260 receive eight corresponding weight members 204. In other embodiments, the club head 200 may include fewer or more than eight weight receptacles 260 (e.g., one, two, three, four, five, six, seven, nine, ten, eleven, twelve, thirteen, fourteen, fifteen, or more than fifteen weight receptacles) for receiving fewer or more than eight corresponding weight members 204 (e.g one, two, three, four, five, six, seven, nine, ten, eleven, twelve, thirteen, fourteen, fifteen, or more than fifteen weight members). As shown, all of the illustrated weight receptacles 260 and weight members 204 are cylindrical and have approximately the same respective shapes and volumes. In other embodiments, the weight receptacles 260 can vary in volume and can be spherical, conical, frustoconical, cylindrical, rectangular, or any other suitable geometry, including combinations thereof. The weight members 204 can likewise vary in volume and can be spherical, conical, frustoconical, cylindrical, rectangular, or any other suitable geometry corresponding to the volume and shape of each respective weight receptacle 260. The weight members 204 can each be formed of the same material, some of the weight members can be formed of differing materials having differing material properties (e.g., density, hardness, etc.). Further, enclosing the weight members 204 between the front body 244 and 248 presents beneficial cost advantages as the weight members 204 can merely be bar stock, rather than needing to be polished or finished as required by external weight members.

The front body 244 is made of a relatively less dense material than that of the rear body 248. In the illustrated embodiment, the front body 244 is made of a composite material such as thermoplastic composite ("TPC") (e.g., DuPont™ Vizilon® TPC, thermoplastic polyurethane, etc.). In other embodiments, the front body 244 of the club head 200 can be made of any of one or combination of the following: titanium, aluminum, tungsten, another steel alloy (e.g. 455 steel, 475 steel, 431 steel, 8620 alloy steel, S25C steel, carbon steel, maraging steel, stainless steel, stainless steel alloy, etc.), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, the front body 244 can be formed of carpenter grade 455 steel, carpenter grade 475 steel, C300 steel, C350 steel, a Ni—Co—Cr steel alloy, a quench and tempered steel alloy, or 565 steel. The front body 244 can be formed by any one or combination of the following methods: forging, casting, co-casting, die-casting, milling, 3-D printing, or any other method suitable for making a golf club head.

The rear body 248 is made of a relatively denser material than that of the front body 244. In the illustrated embodiment, the rear body 248 is made of 17-4 stainless steel. In other embodiments, the rear body 248 of the club head 200 can be made of any of one or combination of the following: titanium, aluminum, tungsten, another steel alloy (e.g. 455 steel, 475 steel, 431 steel, 8620 alloy steel, S25C steel, carbon steel, maraging steel, stainless steel, stainless steel alloy, etc.), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, the rear body 248 can be formed of carpenter grade 455 steel, carpenter grade 475 steel, C300 steel, C350 steel, a Ni—Co—Cr steel alloy, a quench and tempered steel alloy, or 565 steel. The rear body 248 can be formed by any one or combination of the following methods: forging, casting, co-casting, die-casting, milling, 3-D printing, or any other method suitable for making a golf club head. In other embodiments, the rear body 248 may be made of the same material as that of the front body 244.

The weight members 204 are made of a relatively denser material than those of the front and rear bodies 244, 248. In the illustrated embodiment, the weight members 204 are made of tungsten. In other embodiments, the weight members 204 can be made of any of one or combination of the following: titanium, aluminum, tungsten, another steel alloy (e.g. 455 steel, 475 steel, 431 steel, 8620 alloy steel, S25C steel, carbon steel, maraging steel, stainless steel, stainless steel alloy, etc.), a titanium alloy (e.g. Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, or any combination thereof), an aluminum alloy, or a composite material. In other embodiments, the weight members 204 can be formed of carpenter grade 455 steel, carpenter grade 475 steel, C300 steel, C350 steel, a Ni—Co—Cr steel alloy, a quench and tempered steel alloy, or 565 steel.

The number, composition, or arrangement of the weight members 204 can be strategically varied to achieve a desired weight of the golf club head 200 or to achieve a desired swing characteristic of the golf club head 200. That is, the overall weight, the distribution of weight, the center of gravity ("CG"), and/or the moment of inertia ("MOI") of the club head 200 can be customized according to user preference and to specific playing conditions by varying the number, composition, or arrangement of the weight members 204 installed within the weight receptacles 260. For example, in some embodiments, some of the weight receptacles 260 may receive respective weight members 204 (i.e. threadable engagement, press fit, etc.), while the remaining, centrally-located weight receptacles 260 may remain unoccupied, in order to achieve a relatively lightened club head 200. In such embodiments, as compared to a club head in which all of the weight receptacles are uniformly occupied, the overall weight of the lightened club head 200 is relatively decreased. The lightened club head 200 would accordingly require a relatively longer stroke or swing distance when striking a golf ball in order to impart a comparable striking force to the ball. Such a lightened club head 200 may be preferable for beginner golfers. In other embodiments, all of the weight receptacles 260 may receive weight members 204, or the weight receptacles may receive relatively heavier weight members 204, in order to achieve a relatively heavier club head 200. The heavier club head 200 would accordingly require a relatively shorter stroke or swing distance when striking the golf ball in order to impart a comparable striking force to the ball. Such a heavier club head 200 may be preferable for highly skilled golfers. As another example, in some embodiments, some of the weight receptacles 260 located proximate the back end 216 may be occupied while other weight receptacles 260 located proximate the front end 212 may remain unoccupied. Such an arrangement would tend to shift the CG of the club head 200 toward the back end 216.

The size and or shape of the front and/or rear body 244, 248 may be customized at the time of manufacturing of the club head 200 according to the preferences of each user. Additionally, aesthetic features of the front and/or rear bodies 244, 248 may also be customized at the time of manufacturing. For example, a user can select from a number of aesthetic options including different colors, surface patterns, textures, etc. of the front and rear bodies 244, 248.

By enclosing the weight members 204 between the front and rear bodies 244, 248, the club head 200 mimics the appearance of a club head of unitary construction (e.g., a forged club head) while also achieving the improved feel, swing characteristics (e.g., CG low and away, high MOI, etc.), and adaptability afforded by the customizable weight members 204. The weight members 204 and weight receptacles 260 allow the golf club head 200 to be adapted and customized during manufacturing but appear to be unitary in construction at the time of use. The golf club head 200 also achieves superior sound characteristics as compared to club heads having external weight members or mechanically fastened weight members, since the enclosed weight members 204 do not rattle within external holes.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to a variety of types of golf clubs including drivers, fairway woods, hybrids, crossovers, or any hollow body type golf clubs. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described in detail with reference to certain preferred embodiments, variations and modifications exist within the scope and spirit of one or more independent aspects of the invention as described.

Clause 1: a golf club head comprising: a body having a front end, a back end opposite the front end, a heel end, a toe end opposite the heel end, a top rail, and a sole opposite the top rail, the body further including a front body defining the front end and portions of the heel end, the toe end, the top rail, and the sole, the front body being formed of a first material having a first density; a rear body coupled to the front body, the rear body defining the back end and portions of the heel end, the toe end, the top rail, and the sole, the rear body being formed of a second material having a second density; a plurality of weight receptacles defined in one or both of the front body and the rear body; one or more weight members received into the weight receptacles, the one or more weight members being formed of a third material having a third density; wherein the one or more weight members are fully enclosed between the front body and the rear body; and wherein the first density is greater than the second density, and the third density is greater than the first density.

Clause 2: the golf club head of clause 1, wherein the front body includes a first mating surface, and the rear body includes a second mating surface that mates with the first mating surface to join the rear body to the front body, and wherein a receptacle bank protrudes away from one of the first mating surface and the second mating surface, and wherein the weight receptacles are defined within the receptacle bank.

Clause 3: the golf club head of clause 2, wherein the receptacle bank comprises a first receptacle bank located proximate the heel and a second receptacle bank located proximate the toe end, the first and second receptacle banks extending generally lengthwise between the front end and the back end.

Clause 4: a golf club head comprising: a front body including a strikeface and a first mating surface opposite the strikeface; a rear body having a second mating surface that mates with the first mating surface to couple the rear body to the front body, the front and rear bodies cooperating to define a top rail and a sole opposite the top rail; weight receptacles defined in the first mating surface; one or more weight members received into the weight receptacles and fully enclosed between the front and rear bodies; wherein the first mating surface is divided into a substantially planar upper first mating surface extending closer to the top rail, and a substantially planar lower first mating surface extending closer to the sole and oriented at an angle relative to the upper first mating surface, wherein the weight receptacles are defined in the lower first mating surface.

Clause 5: the golf club head of clause 4, wherein the upper first mating surface extends generally parallel to the strikeface.

Clause 6: the golf club head of clause 4, wherein the angle is between 60 and 175 degrees.

Clause 7: the golf club head of clause 4, wherein each weight receptacle receives a respective weight member.

Clause 8: a system of golf club heads comprising: a first golf club head including a first front body, a first rear body joined to the first front body, and one or more first weight members enclosed between the first front body and the first rear body, the first front body and the first rear body cooperating to define a first sole surface of the first golf club head, the first rear body defining a first sole surface portion of the first sole surface; a second golf club head including a second front body identical to the first front body, a second rear body joined to the second front body, and one or more second weight members enclosed between the second front body and the second rear body, the second front body and the second rear body cooperating to define a second sole surface of the second golf club head, the second rear body defining a second sole surface portion of the second sole surface; wherein the second sole surface portion has a larger area than the first sole surface portion.

Clause 9: the system of clause 8, wherein each of the first and second front bodies are formed of a first material, and each of the first and second rear bodies are formed of a second material different than the first material.

Clause 10: the system of clause 8, wherein each of the first and second front bodies includes weight receptacles that receive the respective first weight members and second weight members.

The invention claimed is:

1. A golf club head comprising:

a body comprising a front body and a rear body coupled to the front body;

wherein the golf club head comprises a front end, a back end opposite the front end, a heel end, a toe end opposite the heel end, a top rail, a sole opposite the top rail;

the front body including a strikeface and a first mating surface opposite the strikeface;

the rear body having a second mating surface that mates with the first mating surface to couple the rear body to the front body;

wherein the front body is formed of a first material having a body first density, and the rear body is formed of a second material having a body second density;

wherein the body first density is greater than the body second density;

the front body and the rear body cooperating to define a top rail and a sole opposite the top rail;

wherein the first mating surface is divided into a substantially planar upper first mating surface extending closer to the top rail, and a substantially planar lower first mating surface extending closer to the sole and oriented at an angle relative to the upper first mating surface;

wherein the upper first mating surface and the lower first mating surface form a first single, continuous surface;

wherein the second mating surface is divided into a substantially planar upper second mating surface extending closer to the top rail, and a substantially planar lower second mating surface extending closer to the sole and oriented at an angle relative to the upper second mating surface;

wherein the upper second mating surface and the lower second mating surface form a second single, continuous surface;

a receptacle bank is defined in both of the first mating surface and the second mating surface;

wherein the receptacle bank defines a plurality of weight receptacles;

a first weight receptacle and a second weight receptable disposed towards the heel end;

a third weight receptacle and a fourth weight receptacle disposed towards the toe end;

a fifth weight receptacle and a sixth weight receptacle disposed between the first and second weight receptacles and third and fourth weight receptacles;

wherein the first weight receptacle and second weight receptacle receive one or more heel weight members comprising a weight first density:

wherein the third weight receptacle and fourth weight receptacle receive one or more toe weight members comprising the weight first density;

wherein the fifth weight receptacle and the sixth weight receptacle receive one or more central weight members comprising a weight second density;

wherein the one or more toe and heel weight members are fully enclosed between the front body and the rear body; and wherein the front body and the rear body are secured to one another via a connection between the first mating surface and the second mating surface.

2. The golf club head of claim 1, wherein the weight first density is less than the weight second density.

3. The golf club head of claim 1, wherein each weight receptacle receives a respective weight member.

4. The golf club head of claim 1, wherein the plurality of weight receptacles includes more than six weight receptacles.

5. The golf club head of claim 1, wherein the golf club head is devoid of a cavity.

6. The golf club head of claim 1, wherein a portion of the rear body that forms a portion of the sole forms between 30% and 50% of the sole.

7. The golf club head of claim 1, wherein the upper first mating surface extends generally parallel to the strikeface.

8. The golf club head of claim 1, wherein the lower first mating surface comprises a height measured in a top rail-to-sole direction ranging between 0.1 inch and 1.0 inch.

* * * * *